United States Patent [19]

Couch

[11] 4,335,545

[45] Jun. 22, 1982

[54] INFLATABLE TENT

[76] Inventor: James L. Couch, 13433 Dyer, Sylmar, Calif.

[21] Appl. No.: 116,386

[22] Filed: Jan. 29, 1980

[51] Int. Cl.[3] ..... E04B 1/345

[52] U.S. Cl. ..... 52/2

[58] Field of Search ..... 52/2; 135/1 R, DIG. 7; 47/17; 137/527

[56] References Cited

U.S. PATENT DOCUMENTS

| | | | |
|---|---|---|---|
| 2,754,836 | 7/1956 | Darby | 52/2 |
| 2,830,606 | 4/1958 | Daugherty | 52/2 |
| 2,900,994 | 8/1959 | Igoe | 52/2 |
| 3,059,656 | 10/1962 | Seubert et al. | 52/2 |
| 3,332,177 | 7/1967 | Sepp | 52/2 |
| 3,899,853 | 8/1975 | Wertman | 52/2 |
| 4,012,867 | 3/1977 | Lainchburg et al. | 47/17 |

FOREIGN PATENT DOCUMENTS

| | | | |
|---|---|---|---|
| 2803348 | 8/1979 | Fed. Rep. of Germany | 135/DIG. 7 |
| 2365978 | 4/1978 | France | 52/2 |
| 710121 | 6/1966 | Italy | 52/2 |

*Primary Examiner*—J. Karl Bell

*Attorney, Agent, or Firm*—Sanford Astor

[57] ABSTRACT

This invention relates to an inflatable air celled tent in which the body of the tent consists of a series of air cells each of which has a one way valve, so that if any one of the cells is punctured the entire tent will not collapse.

4 Claims, 5 Drawing Figures

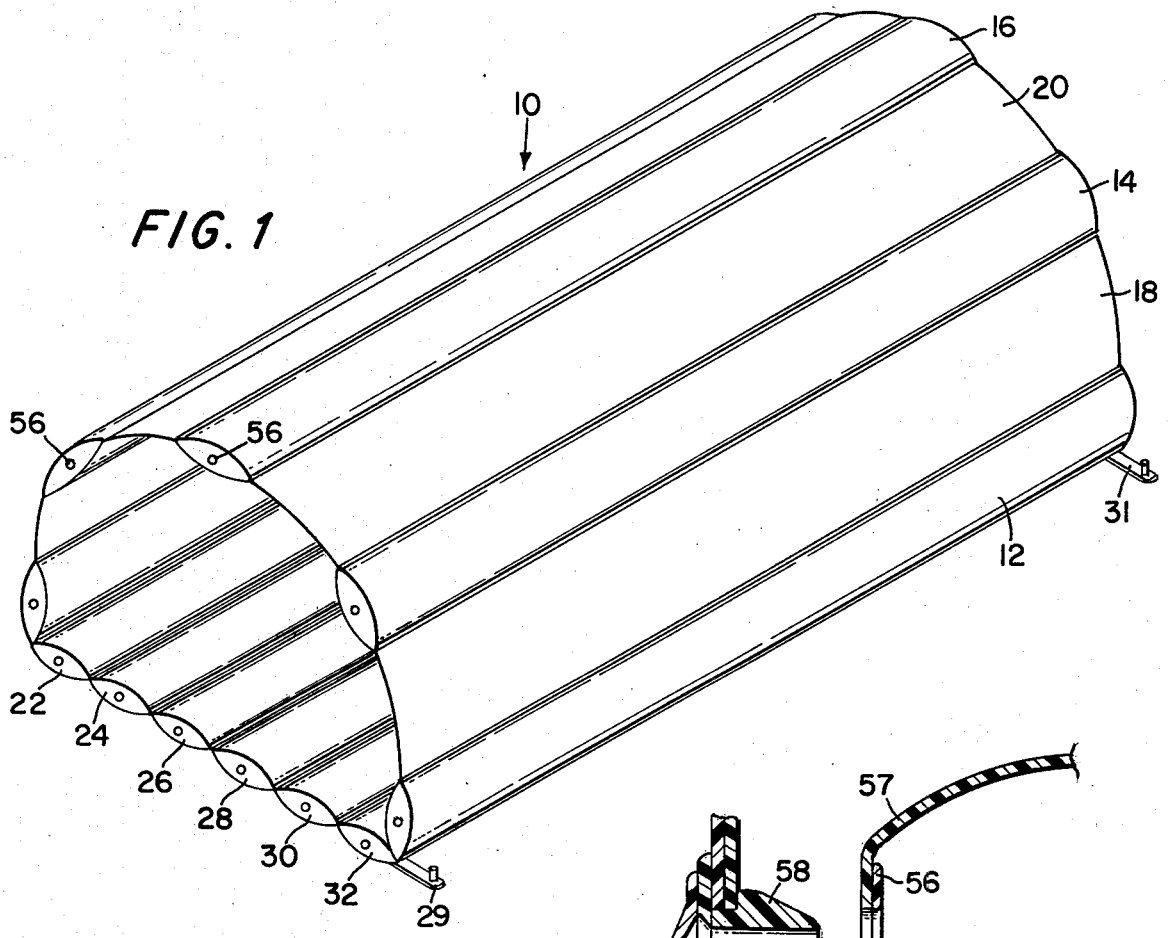
FIG. 1
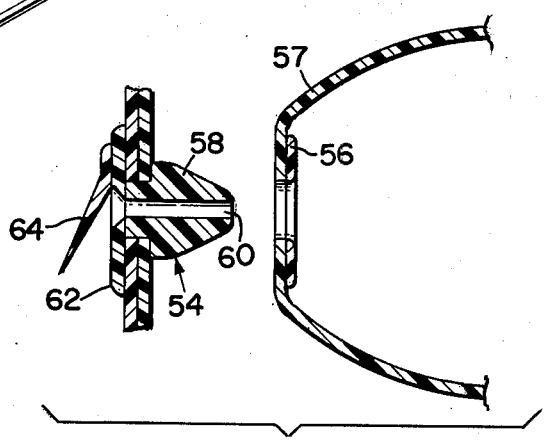
FIG. 4
FIG. 3
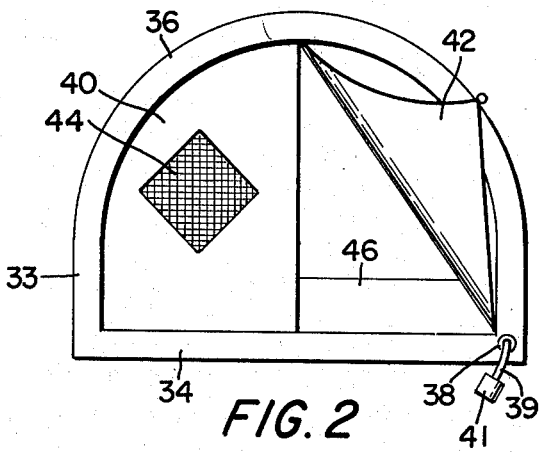
FIG. 2
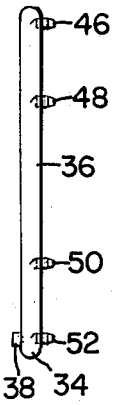
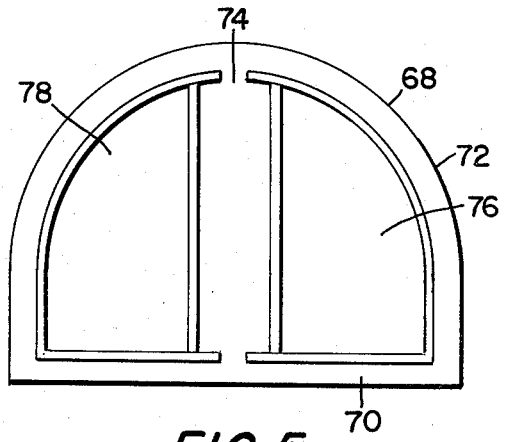
FIG. 5

INFLATABLE TENT

BACKGROUND OF THE INVENTION

Camping and backpacking have become extremely popular pastimes in our society. Camping tents are a necessary part of this pastime. There are a great number of tents on the market which the camper may purchase. Most of these require extensive time and effort to set up, if they are of any size. Most tents require poles to hold the tent up and stakes to hold the tent to the ground.

Some inflatable tents have been invented however these have suffered from the problem that a puncture of the tent collapses the whole tent.

It is an object of the present invention to provide a camping tent which can be put up in a minimum of time. Another object of this invention is to provide an inflatable tent designed so that puncture of the tent at any one place will not deflate and collapse the entire tent.

These and other objects will become obvious from the following description and drawings of which:

FIG. 1 is a perspective view of the tent of the present invention.

FIG. 2 is a plan view of the front portion of the tent of this invention.

FIG. 3 is a side view of the front portion shown in FIG. 2.

FIG. 4 is a side elevation view of the one way valve utilized in this invention.

FIG. 5 is a front view of the back of the tent of the present invention.

Referring to FIG. 1 there is shown the body or major structure 10 of the tent of the present invention. The body 10 is composed of a series of air cells 12, 14, 16 which are adjacent to each other and form the upper portion of the tent. These air cells are separated by solid sheets of material 18, 20.

The material of which the tent is made may be any material which may be sealed together so that the alternating air cells and material may be sealed into a single unit. This material can be lightweight vinyl, rubber or a variety of synthetics. A particularly good material is a plastic laminate such as that made by Griffolyn Co. which is flame retardant.

A series of adjacent air cells 22, 24, 26, 28, 30, 32 pass across the bottom of the tent and provide an air mattress for sleeping comfort. These air cells are sealed one to the other so that in the base of the tent there is not the alternating of the air cell and the material as in the top of the tent.

The air cells in both the top of the tent and in the bottom are sealed one to the other by any convenient sealing means, the easiest of which is a heat seal. Each air cell has a flange or piece of material extending past the closed portion of the cell and these flanges may be sealed together to provide the alternating air cells or the alternating air cells and strips of material.

In the front of each air cell is the female portion of the valve 56 later described in detail in FIG. 4. This valve provides the entry for the air for each cell.

Tie down straps 29, and 31 are shown to tie the tent to the ground.

Referring now to FIG. 2 there is shown the front portion 33 of the tent of this invention. The front portion consists of hollow tubing manufactured from the same material as the tent and in the shape of the front of the tent, that is, a horizontal tubing 34 and an inverted u-shape tubing 36 which form one unit in the shape of the front of the tent. An air intake valve 38 is in the lower corner of the front portion. Attached to the air intake valve is an inlet line 39 to which may be attached a source of air 41 to blow up the tent. The most convenient method is to use a carbon dioxide cartridge which is available containing 124 pounds of pressure in a small capsule. This may be left attached to the inlet line 39 while the tent is in use.

The front portion also contains the front closing flaps 40 and 42 which provide the opening to the tent. The front flap 40 may have a window with netting 44 and both flaps 40 and 42 may fold back. An insect guard 46 extends upward from the bottom of the tent 34 to prevent insects from crawling into the tent.

FIG. 3 shows a side view of the front portion 33 shown in FIG. 2. The inverted u-shape tubing 36 forms a singular unit with the bottom tubing 34. The air intake valve 38 is located in the bottom of the front unit. Fixidly attached inside the front portion 33 are the male portions of one-way valves 46, 48, 50 and 52 described in more detail in FIG. 4. These male portions fit into female portions 56 in the front of each air cell 57 and by this method, the front of the tent, shown in FIG. 2 is snapped into and attached to the air cells as shown in FIG. 1.

Referring now to FIG. 4 there is shown the male portion 54 of the one way valve utilized in this invention and the female portion 56. As stated the male portion 54 is fixedly attached to the front portion of the tent as shown in FIG. 3, while the female portion 56 is fixedly attached inside the front of each air cell as shown in FIG. 1. The one way valve consists of a beveled cylinder 58 containing an air passage 60 through which air can be introduced at the base 62. This portion also contains a movable flap 64 which raises when air is introduced and would close if air were rushing out of the air cell into which it were inserted.

These male portions 54 of the one way valve are fixidly attached into holes in the front portion 33 as shown in FIG. 3 and snapped into place or sealed to the front portion 33. They are arranged so that the flaps 64 face the air intake valve 38 so that when air is introduced into the front portion of the tent as shown in FIG. 2 the air pushes in such a direction that flap 64 is forced open so that the air may be introduced through passage 60 into the air cell in which it is placed. The male portion 54 of the one way valve snaps into or is sealed into the female portion 56 which is in side the front of each air cell by this method the front of the tent shown in FIG. 2 is fixed into the air cells as shown in FIG. 1. It can be seen that the flaps 64 are so arranged so that when air is introduced to blow up the tent the flaps in each air cell are open so that air may pass through the passages 60 in the one way valve and into each air cell until the tent is blown up fully. When air is no longer introduced the flaps will close. Should any one air cell be punctured, as air rushes out of the cell and there is a reduced pressure within the air cell, there is a higher pressure on the outside of the valve, the flap 64 will stay in a closed position so that only the air in the cell punctured will escape and none of the other air in the tent will escape.

Referring now to FIG. 5 there is shown the back of the tent 68 with a horizontal air cell 70 and an inverted u-shaped cell 72 forming the back in the shape of the tent and open to the air cells. In addition, an air cell 74 passes vertically down the back of the back portion 68 of the tent. This provides support for the tent. The back of the tent 68 is closed, the portions 76 and 78 being solid strips of material. If desired there may be windows placed in these strips.

In operation the tent is completely put together, that is, the front portion 33 and the back portion 68 are already sealed to the air cells and the entire tent may be folded into a very small package. When the tent is used in the field it is unfolded and the carbon dioxide cartrige is attached to the inlet tube 39 of the tent. The cartridge is then opened and the entire tent is inflated in a matter of seconds. The tent may then be attached to the ground by tie down straps 29 and 31 and similar straps on the other side. In a matter of minutes the tent is set up in the field. The $CO_2$ cartridge is simply left attached to the intake tube.

As shown the tent is supported entirely by air cells and no poles or ropes are necessary.

To deflate the tent the $CO_2$ cartridge may be removed and the air squeezed out of the air cells. When the $CO_2$ cartridge is removed and the air line 39 is open to the atmosphere, pressure on the air cells will force air back out of the one-valves 54 and flap 64 will open since a higher pressure will exit inside the air cell than outside of the flap 64.

The rear of the tent 68 is sealed around the edges to the rear of the air cells 12, 14, 16 and the bottom cells 22, 24, 26, 28, 30, 32 by heat sealing.

The front of the tent 34 is also sealed around the edges to the front portion of the same main air cells. This is done for a complete sealing of the units together.

The tent is designed for backpackers, campers, hunters and for emergency situations since the tent inflates in seconds and offers instant shelter and warmth in a rain, storm or fowl weather. As stated the tent is made of a flame retardant material.

Having described the invention I claim:

1. An inflatable tent comprising a plurality of alternating air cells and strips of material forming the body, each air cell containing a plurality of female portions of air inlet valves, a front portion comprising an air cell, a single air intake valve in the front portion, a plurality of male portions of one-way valves adapted to pass air into each female portion of the air inlet valves in each cell from the front portion air cell, said one-way valves also adapted to close upon the release of air from a cell.

2. The device of claim 1 wherein the front section has closing flaps.

3. The device of claim 1 wherein the bottom of the tent comprises a series of air cells forming an air mattress.

4. The device of claim 1 comprising a rear closing section.

* * * * *